US009447706B2

(12) United States Patent
Dautel et al.

(10) Patent No.: US 9,447,706 B2
(45) Date of Patent: Sep. 20, 2016

(54) BEARING FRAME OR CYLINDER HEAD COVER

(71) Applicant: Mahle International GmbH, Stuttgart (DE)

(72) Inventors: Frank Dautel, Gerlingen (DE); Thomas Flender, Eberdingen (DE); Klaus Heidenberger, Sauldorf-Rast (DE); Antonio Menonna, Ditzingen (DE); Kurt Schwellenbach, Neufahrn (DE); Stefan Steichele, Gerlingen (DE)

(73) Assignee: Mahle International GmbH (DE)

( * ) Notice: Subject to any disclaimer, the term of this patent is extended or adjusted under 35 U.S.C. 154(b) by 329 days.

(21) Appl. No.: 14/261,054

(22) Filed: Apr. 24, 2014

(65) Prior Publication Data

US 2015/0308299 A1 Oct. 29, 2015

(30) Foreign Application Priority Data

Apr. 25, 2013 (DE) ..... 10 2013 207 573

(51) Int. Cl.

| | |
|---|---|
| ***F02B 77/00*** | (2006.01) |
| ***F01L 1/053*** | (2006.01) |
| ***F02F 7/00*** | (2006.01) |
| *F01L 1/047* | (2006.01) |
| *F01M 9/10* | (2006.01) |

(52) U.S. Cl.

CPC ..... *F01L 1/053* (2013.01); *F02F 7/006* (2013.01); *F01L 2001/0476* (2013.01); *F01L 2001/0537* (2013.01); *F01M 9/102* (2013.01)

(58) Field of Classification Search

CPC ..... F01L 2001/0476; F02F 7/0053
USPC ..... 123/90.6, 195 C
See application file for complete search history.

(56) References Cited

U.S. PATENT DOCUMENTS 5,065,507 A * 11/1991 Wakamori ..... B07C 5/3412 29/407.04
5,101,554 A * 4/1992 Breuer ..... B21D 39/04 29/421.1
7,707,983 B2 * 5/2010 Ueno ..... F01L 1/047 123/90.31

(Continued)

FOREIGN PATENT DOCUMENTS

DE 3126280 C1 1/1983
DE 4209153 A1 9/1992

(Continued)

OTHER PUBLICATIONS

German Search Report for German Patent Application No. 102013207573.1 dated Nov. 19, 2014.

(Continued)

*Primary Examiner* — Marguerite McMahon
*Assistant Examiner* — James Kim
(74) *Attorney, Agent, or Firm* — Fishman Stewart PLLC

(57) ABSTRACT

A bearing frame or cylinder head cover of an internal combustion engine may include at least one camshaft mounted therein. The camshaft may be tunnel-mounted in at least two bearing openings arranged along a bearing channel. At least two radial bearings may be arranged on the camshaft, each of the radial bearings having an outer bearing shell. The outer bearing shells of the at least two radial bearings may include different outer diameters, each of the respective outer diameters adapted to be complementary to an inner diameter of the associated bearing opening. The inner diameters of the bearing openings may decrease in a direction of assembly of the camshaft along the bearing channel.

20 Claims, 3 Drawing Sheets

(56) References Cited

U.S. PATENT DOCUMENTS

| | | | | |
|---|---|---|---|---|
| 7,775,186 | B2 * | 8/2010 | Sakurai | B21D 53/845 123/90.16 |
| 2008/0149064 | A1 | 6/2008 | Shibata et al. | |
| 2012/0031366 | A1 * | 2/2012 | Dunlavey | F02F 7/0053 123/195 H |
| 2014/0261265 | A1 * | 9/2014 | Lonowski | F01L 1/34413 123/90.17 |

FOREIGN PATENT DOCUMENTS

| | | | |
|---|---|---|---|
| DE | 10332630 | A1 | 3/2005 |
| DE | 102005014680 | A1 | 8/2006 |
| DE | 102007024092 | A1 | 11/2008 |
| DE | 102011012149 | A1 | 9/2012 |
| DE | 102011081486 | A1 | 2/2013 |
| JP | 2006-152837 | | 6/2006 |

OTHER PUBLICATIONS

English Abstract for JP2006152837A.
English Abstract for DE3126280C1.
English Abstract for DE4209153A1.
English Abstract for DE10332630A1.
English Abstract for DE102005014680A1.
English Abstract for DE102007024092A1.
English Abstract for DE102011012149A1.
English Abstract for DE102011081486A1.

* cited by examiner

BEARING FRAME OR CYLINDER HEAD COVER

CROSS-REFERENCE TO RELATED APPLICATIONS

This application claims priority to German Patent Application No. 10 2013 207 573.1, filed Apr. 25, 2013, the contents of which are hereby incorporated by reference in their entirety.

TECHNICAL FIELD

The present invention relates to a bearing frame or a cylinder head cover of an internal combustion engine, comprising at least one camshaft mounted therein according to the preamble of the claim 1. The invention also relates to an internal combustion engine comprising such a bearing frame or such a cylinder head cover.

BACKGROUND

Closed bearing frames or cylinder head covers principally offer the great advantage that they can be pre-assembled in a cost-effective manner. Moreover, they are relatively stiff and light, which is a decisive advantage in particular when used in motor vehicles. However, assembling a camshaft in such a closed bearing frame or such a cylinder head cover requires holding the individual components, for example cams, in their joining position and subsequent inserting a shaft tube of the camshaft, which is complicated and prone to error. Under certain circumstances, this can result in a high reject rate which, of course, has to be avoided. As an alternative, it is also conceivable to manufacture the camshafts separately, i.e., to join the cams and functional components separately on the shaft tube, as a result of which the reject rate can be reduced significantly. However, for a desired tunnel mounting, such completely pre-assembled camshafts require that comparatively large bearing openings are provided through which the camshaft together with the cams can be slid. Thus, the bearing diameter is significantly larger than the shaft diameter, which is contrary to the desire of minimizing friction. When using antifriction bearings, the mentioned friction problem is even more serious in the case of a large diameter of the bearing.

SUMMARY

The present invention therefore is concerned with the problem of providing an improved embodiment for a bearing frame or a cylinder head cover of the generic kind, which avoids the disadvantages known from the prior art.

This problem is solved according to the invention by the subject matters of the independent claims. Advantageous embodiments are subject matter of the dependent claims.

The present invention is based on the general idea of utilizing each of the advantages of previous assembly methods separately and thereby to implement overall a simplified and improved assembly of a prefabricated camshaft in a bearing frame or a cylinder head cover. The bearing frame according to the invention or the cylinder head cover according to the invention thus enables high-quality separate manufacturing of the camshafts which are subsequently installed in the pre-assembled state in the respective bearing frame or in the respective cylinder head cover and are tunnel-mounted therein, wherein comparatively small bearing diameters are sufficient. Accordingly, the bearing frame according to the invention or the cylinder head cover according to the invention comprise at least one camshaft that is mounted therein and is tunnel-mounted in at least two bearing openings arranged along a bearing channel. On the camshaft, there are arranged at least two radial bearings, each of which has an outer bearing shell, wherein the respective outer bearing shells of at least two radial bearings have different outer diameters that are in each case formed complementary to an inner diameter of the associated bearing opening. Here, the inner diameters of the bearing openings decrease in the direction of assembly of the camshaft in the bearing frame or in the cylinder head cover so that the previously separately pre-fabricated camshaft can be slid as a whole into the bearing openings that form the bearing channel of the cylinder head cover or the bearing frame. By assembling also the outer bearing shell on the camshaft and, at the same time, by the stepped formation of the individual radial bearings, simple and yet high-quality assembling of the camshaft in the bearing frame or the cylinder head cover can be achieved. Here, a standard radial bearing for radially supporting the camshaft in the bearing openings can usually be assembled between individual cams, wherein the standard radial bearing is covered by a bearing ring and thereabove by the already-mentioned bearing shell which, in a particularly advantageous embodiment, is made from the same material as the bearing frame or the cylinder head cover. The bearing ring, however, is usually made from hardened steel that is typically used for bearing surfaces. This also minimizes problems caused by thermal expansion since the bearing frame or the cylinder head cover usually is made of an aluminum material.

In another advantageous embodiment of the solution according to the invention, the bearing shell is arranged in a positive-locking and rotationally fixed manner in the associated bearing opening in the bearing frame or in the cylinder head cover. For this purpose, the bearing shell may have a round outer contour with or without a relief-ground area, an angular outer contour, in particular a triangular or quadrangular or an octagonal contour. For example, due to the round outer contour having a relief-ground area and the angular outer contours, rotating of the bearing shell in the associated bearing opening can be reliably excluded. At the same time, a predefined angular position during assembly can be ensured.

Advantageously, the radial bearing is configured as a sliding bearing or as an antifriction bearing. In particular the configuration as an antifriction bearing, for example as a needle bearing, allows a comparatively smooth-running mounting of the camshaft in the cylinder head cover or in the bearing frame, wherein, of course, sliding bearings are also conceivable, for example a plastic sliding bearing, in particular from a polymer material by means of which optimum sliding properties can be achieved. Of course, it is also conceivable that a metallic sliding bearing is provided which is coated with a polymer material that has good sliding properties.

In another advantageous embodiment of the solution according to the invention, the radial bearing is formed as an antifriction bearing comprising rolling elements, for example needles, running directly on the camshaft, a bearing ring enclosing said needles, and the outer bearing shell. In this case, it is of course also possible that the camshaft is coated or hardened in the region of the radial bearing so as to improve the bearing properties. As an alternative, it is also conceivable that in the region of the radial bearing, an inner bearing ring is arranged on the camshaft, on which inner bearing ring the actual rolling elements, for example, the needles roll. Here, the bearing ring encloses the rolling elements in a manner similar to a bearing cage.

Advantageously, the bearing shell has a stepped outer contour, and the bearing opening has a stepped inner contour formed complementary to the outer contour. This embodiment indicates that the outer contour of the bearing shell can be formed not only as a continuous cylinder surface but, moreover, can be formed from a plurality of cylinder surfaces that are arranged in a step-like manner with respect to each other.

Fixing the bearing shell via a circular spline connection is also possible. Here, the bearing shells are slid into bearing openings and are subsequently press-fitted in the bearing frame or the cylinder head cover by rotating the bearing shells.

Likewise, it is conceivable that at least one bearing shell can be fixed via a bayonet lock in the associated bearing opening of the bearing frame or the cylinder head cover. Through this, disassembling the respective bearing shell and thus also disassembling the camshaft can be simplified. Fixing the respective bayonet locks takes place here by axially inserting the camshaft and rotating it relative to the bearing frame or the cylinder head cover in the rotational direction of the camshaft, whereby self-locking of the bearing shell during operation of the internal combustion engine and yet simple disassembling can be achieved. Of course, as an alternative, it is also conceivable that the bearing shells are arranged in the respective bearing opening of the bearing frame or the cylinder head cover by means of thermal joining or by means of press-fitting.

Further important features and advantages of the invention arise from the sub-claims, from the drawings, and from the associated description of the figures based on the drawings.

It is to be understood that the above-mentioned features and the features still to be explained hereinafter are usable not only in the respective mentioned combination, but also in other combinations or alone, without departing from the context of the present invention.

Preferred exemplary embodiments of the invention are illustrated in the drawings and are explained in more detail in the following description, wherein identical reference numbers refer to identical or similar or functionally identical components.

DETAILED DESCRIPTION

Figure 1:
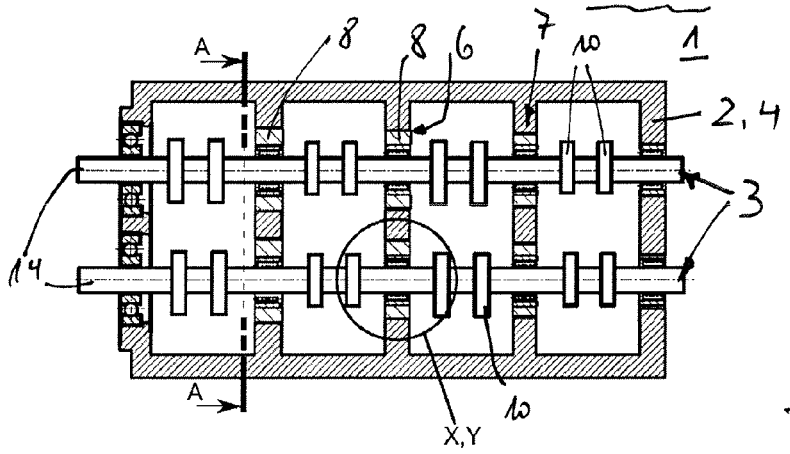
FIG. 1 shows a sectional view through a cylinder head cover or a bearing frame according to the invention with two camshafts arranged therein, FIGS. 2*a, b* show different detailed views of a radial bearing of the camshaft in the cylinder head cover or the bearing frame.
Figure 5:
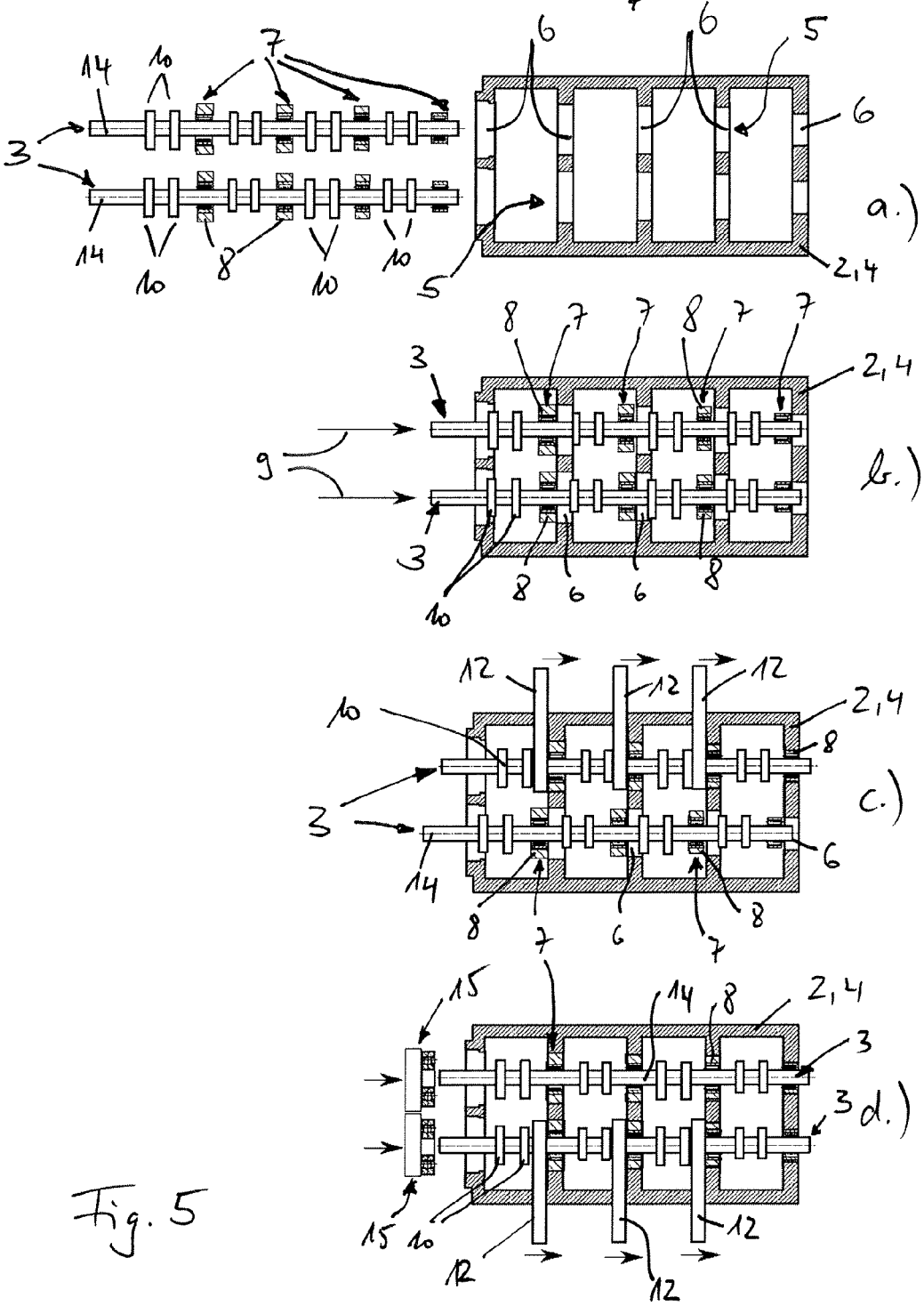
FIGS. 5*a-d* show different assembly steps for assembling the camshaft in the cylinder head cover or in the bearing frame.

According to the FIGS. 1 and 5, at least one, in the present case two camshafts 3 are mounted in an associated bearing frame 2 or in an associated cylinder head cover 4 of an internal combustion engine 1 which, apart from that, is not shown here. According to the invention, the camshaft 3 is tunnel-mounted in at least two bearing openings 6 arranged along a bearing channel 5 (cf. FIG. 5*a*).

Figure 4:
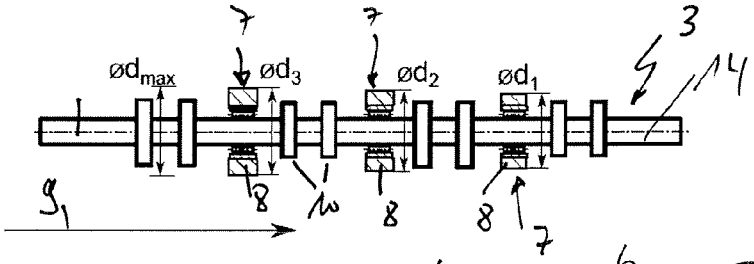
FIG. 4 shows another view of the camshaft according to the invention, based on which the different diameters of the individual radial bearings are illustrated.

In the bearing frame 2 illustrated according to the FIGS. 1 and 5 or the cylinder head cover 4 illustrated therein, five bearing openings 6 for mounting the camshaft 3 are provided in each case. On each camshaft 3 there are arranged at least two radial bearings 7, in the present case in each case four radial bearings 7, each of which has an outer bearing shell 8. The outer bearing shells 8 have different outer diameters $d_1$, $d_2$, $d_3$ and $d_4$, each of which is adapted to be complementary to an inner diameter of the associated bearing opening 6. Furthermore, the inner diameters of the bearing openings 6 and consequently also the outer diameters $d_1$ to $d_4$ of the radial bearings 7 or the bearing shells 8 decrease in the direction 9 of assembly (cf. FIGS. 4 and 5). This makes it possible to separately prefabricate the respective camshafts 3 together with the cams 10 arranged thereon and also with the radial bearings 7 arranged thereon, as a result of which the camshafts can be produced not only in a cost-effective manner but also with high quality. Due to the different outer diameters of the individual bearing shells 8 it is still possible to assemble the separately preassembled camshaft 3 in a closed tunnel mounting of a closed bearing frame 2 or a closed cylinder head cover 4, whereby, in turn, the latter can be built in a comparatively stiff and yet lightweight manner.

Figure 3:
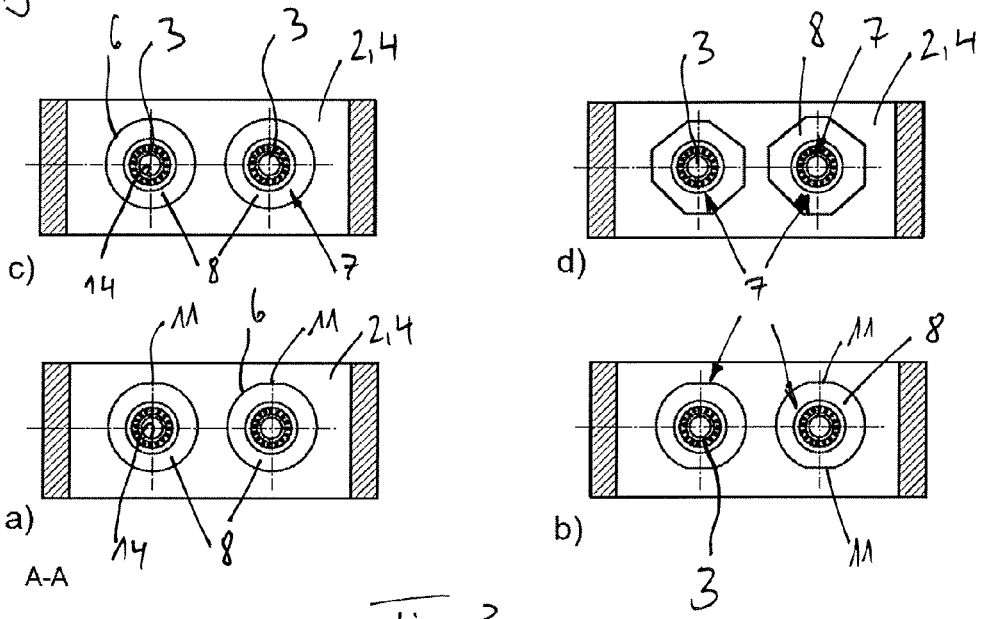
FIGS. 3*a-d* show a sectional view through the bearing frame shown according to FIG. 1 or through the cylinder head cover shown according to FIG. 1, along the sectional plane A-A for bearing shells with different outer contours.

The individual bearing shells 8 are arranged in a positive-locking and, at the same time, rotationally fixed manner in the associated bearing opening 6 in the bearing frame 2 or in the cylinder head cover 4, wherein the bearing shell 8 may have a round outer contour with a relief-ground area 11, as illustrated according to FIG. 3*a*. According to FIG. 3*b*, an embodiment of the bearing shell 8 is shown which has two relief-ground areas 11 per bearing shell 8. Of course, an outer contour of the bearing shell 8 without a relief-ground area 11 is also conceivable, as illustrated, for example, according to FIG. 3*c*. Alternatively, angular outer contours of the bearing shells 8 can also be provided, as shown according to the FIGS. 3*a, b* and *d*, in particular a triangular, a quadrangular or an octagonal outer contour (cf. FIG. 3*d*). All embodiments of the bearing shells 8 have in common that they are arranged in a positive-locking manner in the respective bearing opening 6 of the bearing frame 2 or the cylinder head cover 4.

The radial bearing 7 can generally be configured as an antifriction bearing, in particular as a needle bearing, and alternatively also as a sliding bearing. If the radial bearing 7 is configured as an antifriction bearing, it is conceivable here that rolling elements thereof, for example needles, roll directly on the camshaft and are enclosed by a bearing ring similar to a bearing cage. The bearing shell 8 is arranged so as to enclose the bearing ring. Of course, also conceivable is an embodiment in which the individual rolling elements roll on an inner bearing ring, which is not described in detail here, which is arranged on the camshaft 3. However, in order to be able to minimize the diameter of the individual radial bearings 7, the embodiment in which the individual rolling elements run directly on the camshaft 3 is to be preferred.

Lubricating the individual radial bearings 7 can optionally be carried out via the bearing frame 2 or the cylinder head cover 4, but also via the camshaft 3, wherein in this case, corresponding oil feed channels or oil feed holes have to be provided in the bearing frame 2 or the cylinder head cover 4 and/or in the camshaft 3.

Figure 2:
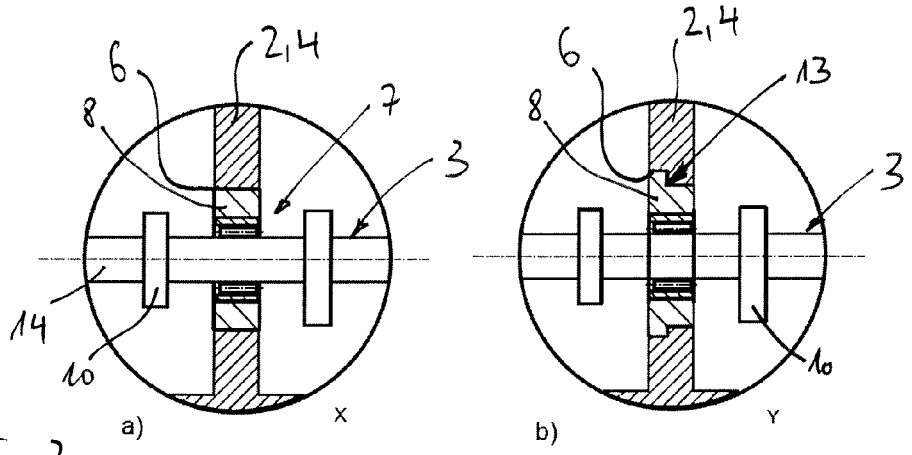

When viewing FIGS. 2*a* and 2*b*, it can be seen that the bearing shell 8 according to FIG. 2*a* is ring-shaped and has a continuous outer contour, whereas the bearing shell 8 according to FIG. 2*b* has a stepped outer contour that is formed complementary to the stepped inner contour of the bearing opening 6. The bearing shells 7 can be pressed into the associated bearing openings 6, for example, by means of assembly aids 12 (cf. FIGS. 5*c* and *d*), or can be joined therein. Alternatively, fixing at least one bearing shell 8 via a bayonet lock 13 in the associated bearing opening 6 of the bearing frame 2 or the cylinder head cover 4 is also conceivable, wherein in this case, closing the bayonet lock 13 is carried out in the rotational direction of the camshaft 3 so that unintended unlocking of the bayonet lock 13 during operation of the internal combustion engine 1 can be reliably excluded.

According to the FIGS. 5*a* to 5*c*, the individual method steps for assembling the camshaft 3 in the cylinder head cover 4 or in the bearing frame 2 are now illustrated. Thus, in the method step according to FIG. 5*a*, first, the two camshafts 3 are separately prefabricated, i.e., the cams 10 and the radial bearings 7 are fixed on a camshaft tube 14. Subsequently, according to the method step shown in FIG. 5*b*, the camshaft 3 or both camshafts 3 are slid in the direction 9 of assembly into the bearing frame 2 or the cylinder head cover 4 until the individual radial bearings 7 are positioned just before the associated bearing openings 6. According to FIG. 5*c*, the individual radial bearings 7 are then slid, for example pressed, by means of assembly aids 12 into the associated bearing openings 6. Analogously, this is also carried out according to FIG. 5*d* with the second camshaft 3. Finally, a combined axial/radial bearing 15 can be pressed in, whereupon the bearing 2 or the cylinder head cover 4 is finish-joined.

With the bearing frame 2 according to the invention or the cylinder head cover 4 according to the invention, the advantages of standardized and high-quality camshaft production, which previously had to be implemented separately, can now be combined with the advantages of a tunnel mounting of such a camshaft 3 in the cylinder head cover 4 or the bearing frame 2.

Figure 6:
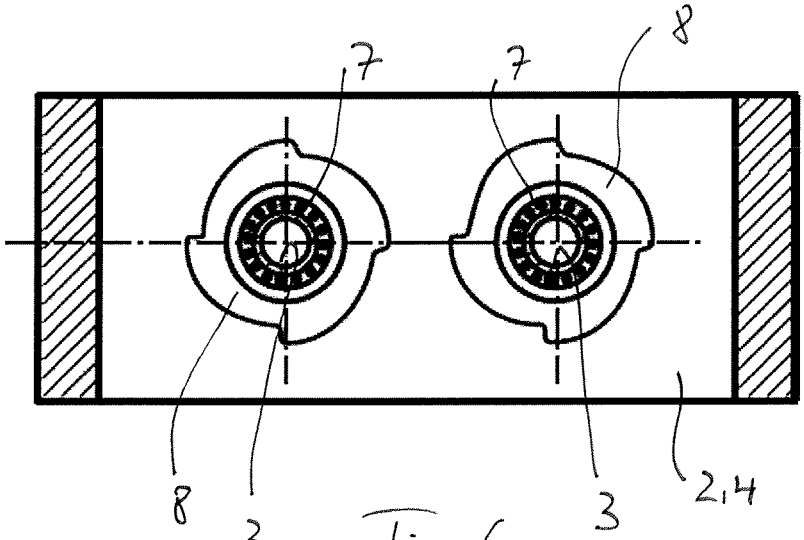
FIG. 6 shows a sectional view through the bearing frame shown according to FIG. 1 or through the cylinder head cover shown according to FIG. 1 along the sectional plane A-A for bearing shells having a circular-spline-shaped outer contour.

FIG. 6 shows two bearing shells 8 which likewise are arranged in a positive-locking and, at the same time, rotationally fixed manner in the associated bearing opening 6 in the bearing frame 2 or in the cylinder head cover 4, wherein the bearing shell 8 has a circular-spline-shaped outer contour similar to a circular saw blade. The circular-spline-shaped bearing shell 8 preferably has rounded splines, which are less sensitive.

During installation, the bearing shells 8 are slid into the bearing openings 6 and subsequently press-fitted or clamped into the bearing frame 2 or the cylinder head cover 4 by rotating the bearing shells 8.

The invention claimed is:

1. A bearing frame or cylinder head cover of an internal combustion engine, comprising: at least one camshaft mounted therein, the camshaft tunnel-mounted in at least two bearing openings arranged along a bearing channel, at least two radial bearings arranged on the camshaft in respective bearing openings, each of the radial bearings having an outer bearing shell, wherein the outer bearing shells of the at least two radial bearings include different outer diameters, each of the respective outer diameters adapted to be complementary to an inner diameter of the associated bearing opening, and wherein the inner diameters of the bearing openings decrease in a direction of assembly of the camshaft along the bearing channel.

2. The bearing frame or cylinder head cover according to claim 1, wherein the respective bearing shells are arranged in a positive-locking and rotationally fixed manner in the associated bearing opening.

3. The bearing frame or cylinder head cover according to claim 1, wherein at least one bearing shell includes at least one of: a round outer contour with a relief-ground area, a round outer contour without relief-ground area and an angular outer contour.

4. The bearing frame or cylinder head cover according to claim 1, wherein at least one radial bearing includes at least one of a sliding bearing and an antifriction bearing.

5. The bearing frame or cylinder head cover according to claim 4, wherein at least one radial bearing includes the antifriction bearing comprising rolling elements running directly on the camshaft, wherein a bearing ring encloses said rolling elements.

6. The bearing frame or cylinder head cover according to claim 1, wherein oil supply for lubricating the radial bearing occurs via at least one of (i) the camshaft and (ii) the cylinder head cover or bearing frame.

7. The bearing frame or cylinder head cover according to claim 1, wherein at least one bearing shell has a stepped outer contour, and the associated bearing opening has a stepped inner contour complementary to said outer contour.

8. The bearing frame or cylinder head cover according to claim 1, wherein at least one bearing shell is fixed in the associated bearing opening via at least one of a bayonet lock and a circular spline connection.

9. An internal combustion engine, comprising: at least one of a bearing frame and a cylinder head cover;

at least one camshaft tunnel-mounted in at least two bearing openings arranged along a bearing channel; and at least two radial bearings arranged on the camshaft and in the respective bearing openings, the at least two radial bearings each having an outer bearing shell;

wherein at least one bearing shell includes a stepped outer contour and the associated bearing opening includes a complimentary stepped inner contour;

wherein the outer bearing shells of the at least two radial bearings include variable outer diameters, the respective outer diameters being complimentary to an inner diameter of the associated bearing opening;

wherein the inner diameters associated with the bearing openings decrease in a direction of assembly of the camshaft along the bearing channel.

10. A method for assembling a camshaft in a bearing frame or a cylinder head cover of an internal combustion engine, comprising:

prefabricating the camshaft together with at least two radial bearings and at least one cams, the at least two radial bearings each including a bearing shell having a defined outer diameter, positioning the camshaft into a bearing channel of the bearing frame or the cylinder head cover, the bearing channel including bearing openings having inner diameters complimentary to the associated outer diameters of the bearing shells, arranging the at least two radial bearings into the associated bearing openings of the bearing frame or the cylinder head cover via an assembly aid, wherein the respective bearing shells of the at least two radial bearings include variable outer diameters and the complimentary inner diameters of the associated bearing openings decrease in a direction of assembly along the bearing channel.

11. The bearing frame or cylinder head cover according to claim 1, wherein the at least one bearing shell includes at least one of a triangular, quadrangular and octagonal outer contour.

12. The bearing frame or cylinder head cover according to claim 2, wherein at least one bearing shell is fixed via at least one of a bayonet lock and a circular spline connection in the associated bearing opening.

13. The bearing frame or cylinder head cover according to claim 3, wherein at least one of at least one bearing shell has a stepped outer counter and the associated bearing opening has a stepped inner contour complimentary to said outer contour.

14. The internal combustion engine according to claim 9, wherein the respective bearing shells are arranged in a positive-locking and rotationally fixed manner in the associated bearing opening.

15. The internal combustion engine according to claim 9, wherein at least one bearing shell includes at least one of: a round outer contour with a relief-ground area, a round outer contour without relief-ground area, and an angular outer contour.

16. The internal combustion engine according to claim 9, wherein at least one radial bearing includes at least one of a sliding bearing and an antifriction bearing.

17. The internal combustion engine according to claim 16, wherein at least one radial bearing includes the antifriction bearing having rolling elements running directly on the camshaft, wherein a bearing ring encloses the rolling bearing elements.

18. The internal combustion engine according to claim 9, wherein oil supply for lubricating at least one radial bearing occurs via at least one of the camshaft and the cylinder head cover or bearing frame.

19. The internal combustion engine according to claim 9, wherein at least one bearing shell is fixed in the associated bearing opening via at least one of a bayonet lock and a circular spline connection.

20. The internal combustion engine according to claim 9, wherein the at least one bearing shell includes at least one of a triangular, quadrangular and octagonal outer contour.

* * * * *